US005170946A

United States Patent [19]

Rankin

[11] Patent Number: 5,170,946

[45] Date of Patent: Dec. 15, 1992

[54] SHAPED NOZZLE FOR HIGH VELOCITY FLUID FLOW

[76] Inventor: George J. Rankin, 3620 W. 11th St., Houston, Tex. 77088

[21] Appl. No.: 748,428

[22] Filed: Aug. 22, 1991

[51] Int. Cl.[5] ..... B05B 1/02

[52] U.S. Cl. ..... 239/590; 239/589; 239/600; 239/601

[58] Field of Search ..... 239/589, 590, 590.5, 239/592–595, 600, 601

[56] References Cited

U.S. PATENT DOCUMENTS

| | | | |
|---|---|---|---|
| 1,133,711 | 3/1915 | Cornelius | 239/595 |
| 2,985,384 | 5/1961 | Martin | 239/601 |
| 3,447,756 | 6/1969 | Lawrence, Jr. | 239/601 |
| 4,112,568 | 9/1978 | Hale | 239/592 |

*Primary Examiner*—Andres Kashnikow
*Assistant Examiner*—Karen B. Merritt
*Attorney, Agent, or Firm*—Alton W. Payne

[57] ABSTRACT

A nozzle having a shaped bore formed with a plurality of highly polished and substantially flat surfaces joined together to form a non-circular bore with a non-circular opening for producing a non-circular, high velocity adhesive jet stream.

7 Claims, 1 Drawing Sheet

SHAPED NOZZLE FOR HIGH VELOCITY FLUID FLOW

BACKGROUND OF THE INVENTION

Heretofore, streams of high velocity fluid, typically water, produced for jetting and cutting applications and the like have been produced through nozzles having a round orifice that forms a round or circular cross-section stream. It is apparent that a round stream, particularly a high velocity stream, is subject to rapid disintegration as it travels through air. This is thought to be due to the Von Karman Streets effect along the surface of the flowing stream which produce eddy currents in the surrounding fluid which causes a stream to break up after it leaves the nozzle. High pressure streams having a fan-shaped configuration have been used in the past to clean various surfaces. While streams of this shape have relatively little turbulence and thus suffer relatively small degradation of the spray pattern from air turbulence, these fan-shaped sprays do not provide the high level of concentration of flowing mass obtained from round-shaped streams.

An object of the present invention is to provide a nozzle having a cross-section which is non-circular and which is formed of a plurality of segments having highly polished interior surfaces for fluid contact and for improving the cohesiveness of a stream of high pressure fluid.

Another object of the present invention is to provide a high velocity fluid jet nozzle for providing a nozzle bore which produces a triangular shaped jet stream with the nozzle being formed in three segments, each having a ground and highly polished surface for contact with the fluid.

Yet another object is to provide a high pressure fluid jet formed of three or more ground and polished surfaces so as to produce a non-circular cross-sectional stream. It is a further object to provide a high velocity fluid jet nozzle with highly polished flat segments including a stepped shoulder and an outlet passage having a cross-section slightly larger than the inlet passage cross-section, adjacent to the tapered end of the inlet chamber.

DESCRIPTION OF THE PREFERRED EMBODIMENT

Figure 1:
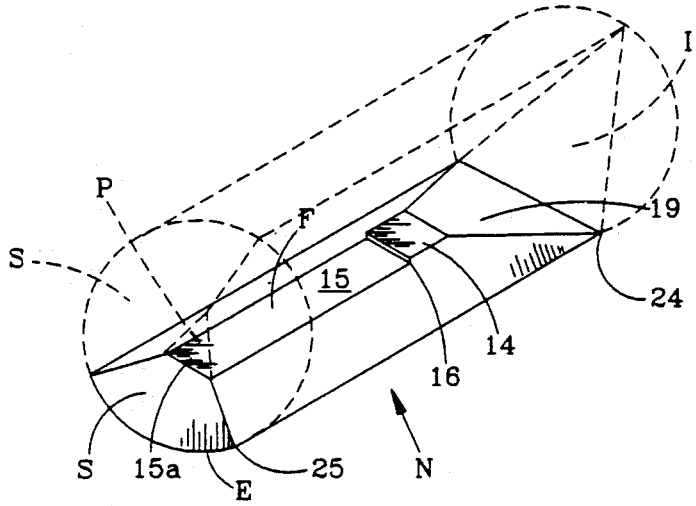
FIG. 1 is an isometric view showing one segment of the three-segment nozzle with a triangular cross-section bore shown in phantom.
Figure 2:
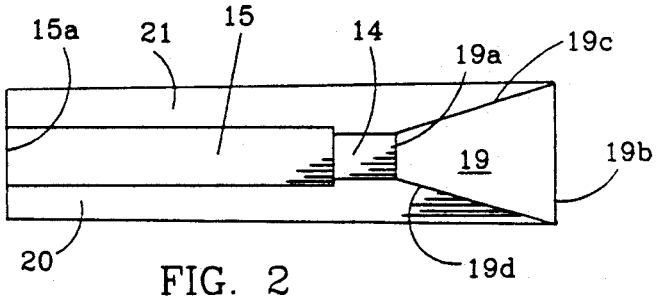
FIG. 2 is a top view of one of the three segments.
Figure 4:
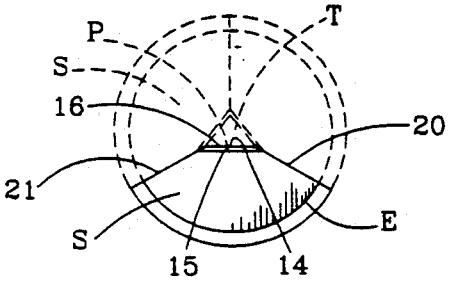
FIG. 4 is an end view of one of the three segments.
Figure 3:
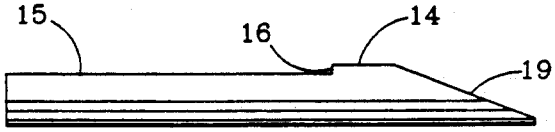
FIG. 3 is a side view of one of the segments.

As shown in FIG. 1, the nozzle designated generally N is formed of a plurality of segments S each having a generally rounded exterior surface E and flat interior surface F which form the interior shape of the nozzle bore when the segments are joined together.

The segments S shown in the drawings include substantially flat surfaces 14 and 15 which form the throat designated generally T and the exit passage designated generally P respectively, when the segments S are joined together. A short shoulder 16 connects the throat surface 14 and the exit passage surface 15. The throat surface 14 is ground and highly polished to provide a very smooth surface for contact by the high pressure fluid passing therethrough.

An inlet chamber I, which is adapted to be secured to a source of high pressure fluid (not shown), is formed adjacent the throat section T in the shape of a truncated three-sided pyramid. This inlet chamber I is formed of inclined surfaces 19 terminating at an inner end 19*a* adjacent the throat surface 14 and a base or outer end 19*b* with inclined edges 19*c* and 19*d*, respectively.

The segment S has inclined sides 20 and 21 which are inclined at approximately 120° relative to each other so as to form a generally round truncated cone-shaped body when placed together side-by-side in a housing (not shown). The conical body thus formed is slightly tapered from one end to the other. As shown, the exterior surface E is tapered from the inlet end 24 adjacent the inlet passage base 19*b* to the outer end 25 adjacent the end 15*a* of the discharge passage with the inlet end 24 being of a slightly larger diameter than the outer end 25.

Figure 5A:
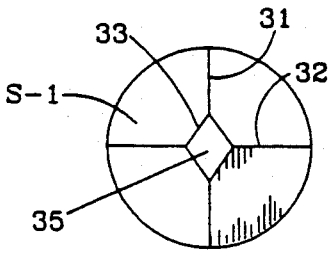
FIG. 5A illustrates a nozzle bore having a diamond-shaped cross-section.
Figure 5B:
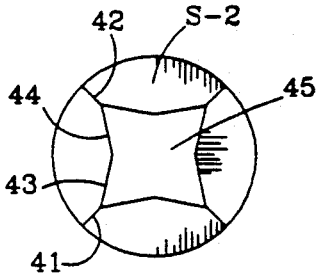
FIG. 5B illustrates a nozzle bore having a star-shaped cross-section.
Figure 5C:
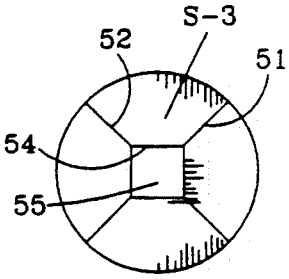
FIG. 5C illustrates a nozzle bore having a square cross-section.

By forming the nozzle bore of a plurality of segments S it is possible to provide smoother surfaces in the bore of the throat T than would be practical if the bore were merely a drilled hole. It will be appreciated that bores of various configurations can be made within the scope of the present invention. For example, FIG. 5A shows a bore having a diamond-shaped cross-section; FIG. 5B shows a bore having a star-shaped cross-section; and FIG. 5C shows a bore having a square cross-section. It will also be appreciated that each of these alternative bore configurations, such as shown in FIGS. 5A through 5C, can be formed using a plurality of segments and thus enable the surfaces presented for contact with the fluid to be ground and highly polished. Also, it will be appreciated that the discharge passages P associated with the various bores as shown in FIGS. 5A, 5B, and 5C will each have a cross-section configuration the same as that of the throat bore with which it is associated and that in each instance the surfaces forming the cross-section will be joined to the adjacent bore surface by a male shoulder, such as 16 in the FIG. 1 embodiment.

As shown in FIG. 5A, the nozzle is formed of four segments S-1. Each segment S-1 has sides 31 and 32 which are arranged at 90° relative to one another and a flat surface 33 therebetween. When arranged as shown in FIG. 5A the segments S-1 are fitted together and the surfaces 33 form the diamond-shaped opening indicated at 35. With this arrangement, such surfaces 33 are exposed in such a way that when the segments S-1 are disassembled the surfaces 33 can be easily ground and polished to a high degree of smoothness.

Similarly, with respect to the nozzle depicted in FIG. 5B, it too is formed of four segments S-2. Each segment S-2 has sides 41 and 42 which are arranged at 90° relative to one another and has inclined surfaces 43 and 44 which together with the similar surfaces on the other segments forms the star-shaped opening indicated at 45. Here again, the surfaces 43 and 44 can be ground and polished to present a very smooth surface to the high pressure fluid flowing through the diamond-shaped opening 45.

With respect to the nozzle illustrated in FIG. 5C, this nozzle also is formed of four segments S-3. The segments S-3 have sides 51 and 52 which are arranged at 90° with respect to each other with a flat plane surface 54 extending therebetween. When assembled as shown in FIG. 5C the segments S-3 are arranged so as to form a square-shaped opening having four sides 54, each of which is ground and polished to present a very smooth surface to the high pressure fluid stream flowing through the opening 55.

It will be appreciated that these and other shapes may be provided so as to generate a high pressure stream of fluid which is highly concentrated and which does not expose rounded surfaces to the adjacent air and thus minimizes turbulence of the stream caused by eddy currents set up in the air through which the stream flows. Additional shapes become readily apparent when the concept of the present invention is understood as described hereinabove.

Having described the invention above, various modifications of the techniques, procedures, material and equipment will be apparent to those in the art. It is intended that all such variations within the scope and spirit of the appended claims be embraced thereby.

I claim:

1. A high velocity fluid jet nozzle for improving cohesiveness of a stream of high pressure fluid comprising a plurality of segments adapted to be joined together to form a non-circular bore having inlet and discharge ends and said non-circular bore including:

(a) an inlet chamber having planar, inclined surfaces adjacent said inlet end and adapted to be connected to a source of high pressure fluid;

(b) a straight sided throat which is smaller in cross-section than said inlet chamber for producing a cohesive stream of fluid having substantially planar sides;

(c) a shoulder for shaping the stream of fluid emerging from the throat into a more cohesive stream of fluid;

(d) a non-circular shaped outlet through which the stream of fluid passes;

(e) an expanded section located between the shoulder and the outlet; and (f) means for improving the cohesiveness of a stream of fluid flowing from the discharge end of the nozzle and contacting with air,

2. The invention of claim 1, wherein said segments include planar surfaces forming said inlet chamber and planar surfaces at said discharge end forming said expanded section.

3. The invention of claim 1, wherein said segments include a tapered curved exterior surface extending from said inlet end to said discharge end and forming a truncated cone when said segments are arranged together.

4. The invention of claim 1, wherein said straight sided throat forms a triangular shaped passageway for forming said cohesive stream of fluid.

5. The invention of claim 4, wherein each of said segments has a pair of inclined sides and said sides are disposed at substantially 120° relative to each other.

6. The invention of claim 1, wherein each of said segments has a pair of sides and said sides are disposed at 90° relative to each other.

7. A high velocity fluid jet nozzle for improving cohesiveness of a stream of high pressure fluid as defined in claim 1 wherein said means for improving the cohesiveness of a stream of fluid flowing from the discharge end of the nozzle and contacting with air comprises said throat, said inlet chamber, and said expanded section being ground and highly polished.

* * * * *